US005923128A

United States Patent [19]

Canova

[11] Patent Number: 5,923,128

[45] Date of Patent: Jul. 13, 1999

[54] ELECTRONIC BALLAST FOR HIGH-INTENSITY DISCHARGE LAMPS

[75] Inventor: Antonio Canova, Montevarchi, Italy

[73] Assignee: MagneTek, Inc., Nashville, Tenn.

[21] Appl. No.: 08/838,440

[22] Filed: Apr. 7, 1997

[30] Foreign Application Priority Data

Oct. 31, 1996 [EP] European Pat. Off. ..... 96830557

[51] Int. Cl.[6] ..... H05B 37/02

[52] U.S. Cl. ..... 315/291; 315/307; 315/224; 315/DIG. 5

[58] Field of Search ..... 315/307, 308, 315/279, DIG. 4, DIG. 5, 291, 224, 302, 299, 300

[56] References Cited

U.S. PATENT DOCUMENTS

| | | | |
|---|---|---|---|
| 4,373,146 | 2/1983 | Bonazoli et al. | 315/209 |
| 5,003,230 | 3/1991 | Wong et al. | 315/279 |
| 5,006,724 | 4/1991 | Liu | 307/11 |
| 5,010,279 | 4/1991 | Lathom et al. | 315/227 R |
| 5,359,341 | 10/1994 | Hutchings | 345/45 |

FOREIGN PATENT DOCUMENTS

| | | |
|---|---|---|
| 90302347 | 3/1990 | European Pat. Off. . |
| 90304275 | 4/1990 | European Pat. Off. . |
| 91306924 | 7/1991 | European Pat. Off. . |
| 96830557 | 10/1996 | European Pat. Off. . |
| 41 23 187 A1 | 1/1993 | Germany . |
| 42 34 358 A1 | 2/1993 | Germany . |
| 43 01 184 A1 | 7/1994 | Germany . |
| PCT/IB95/01106 | 12/1995 | WIPO . |

OTHER PUBLICATIONS

"White–Noise Modulation of High–Frequency High–Intensity Discharge Lamp Ballasts" by Laskai, et al, *IEEE,* Jan. 1994, pp. 1953–1961.

*Primary Examiner*—Don Wong
*Assistant Examiner*—David H. Vu
*Attorney, Agent, or Firm*—Waddey & Patterson; Mark J. Patterson

[57] ABSTRACT

An electronic ballast is used for providing a voltage with a varying frequency to fluorescent lamps. The electronic ballast has an inverter to supply a fluorescent lamp load with a voltage having a high frequency, with the inverter being controlled by a control which generates a switching signal. The ballast further includes a triangular current wave generator which provides a triangular waveform that modulates the frequency of the switching signal controlling the inverter. The modulation of the switching signal causes the frequency of voltage supplied to the fluorescent lamp load to vary from the resonant frequency of the circuit.

5 Claims, 4 Drawing Sheets

DC/DC
13
DISC THRES
GND VCC
+VCC
VREF
INV. IN
N.I. IN
SYNC
OS.OUT
CT
RT
DISC
SOF.STAR
COMP
SHUT
OUTA
GRD
VC
OUTB
VIN
VREF
i 47
t
V

ELECTRONIC BALLAST FOR HIGH-INTENSITY DISCHARGE LAMPS

BACKGROUND OF THE INVENTION

The present invention relates to a power supply or ballast for supplying a load at high frequency, particularly, but not exclusively, for high-intensity discharge (HID) lamps.

Ballasts with a frequency of the order of tens of kHz, typically approximately 20 kHz, are used for the supply of high-intensity lamps, for example metal halide lamps. One of the main problems encountered in the power supply of this type of lamp arises from the fact that resonance phenomena are triggered in the lamp at the power supply frequency, leading to a reduction in the lamp's life.

The resonant frequency varies from one lamp to another in a relatively wide range, and therefore it is impossible to design the ballast in such a way that the power supply frequency automatically excludes the resonant frequency of the lamp.

Various systems have been designed in an attempt to solve the problem mentioned above. In particular, it has been proposed that the lamp should be supplied at a variable frequency, instead of a constant frequency, to prevent the triggering of resonance phenomena. A mathematical analysis of this type of solution is set out in Laszlo Laskai et al., "White-noise modulation of high-frequency high-intensity discharge lamp ballast", 1/1994 IEEE, p. 1953 ff. In this article, to which reference should be made for the analytical examination of the mathematical aspects, it is proposed that the lamp should be supplied with a randomly variable frequency or phase. This requires a rather complex and expensive electronic circuit which is added to the PWM circuit which generates the switching signals.

The object of the present invention is to provide a circuit of a different design which is much simpler and less expensive, to solve the problem of resonance in HID lamps or in loads presenting similar problems supplied by high-frequency ballasts.

SUMMARY OF THE INVENTION

According to the invention, the frequency of the switching signal is varied in time by means of a modulating signal with a triangular waveform, the value of whose frequency is suitably lower, by approximately two orders of magnitude, than the frequency of the switching signal. In terms of circuit design, the proposed solution according to the invention results in a particularly simple circuit solution, compared with the circuits needed for randomly varying the frequency which are used at present.

In practice, the present invention specifies an electronic ballast comprising an inverter section to supply a load at high frequency, control means which generate a switching signal for the inverter section, and means of modulating the frequency of the said switching signals. Characteristically, the switching signal is modulated by the modulating means with a modulating signal having a triangular waveform.

In one practical embodiment, the modulating means comprise a triangular-wave current generator whose output is connected to the plate of a capacitor, the rate of charging of the capacitor determining the frequency of the switching signal.

Characteristically, the switching frequency may be of the order of 10–30 kHz and the frequency of the modulating signal may be of the order of 80–150 Hz. Particularly advantageous values for the modulating signal are of the order of 110–120 Hz and preferably approximately 115–120 Hz.

In one possible embodiment, the modulating means comprise a timer connected to an operational amplifier which controls the turning off and on of a transistor.

The invention will be more clearly understood from the description and the attached drawing, which shows a non-restrictive embodiment of the invention.

DESCRIPTION OF THE PREFERRED EMBODIMENT

Figure 1:
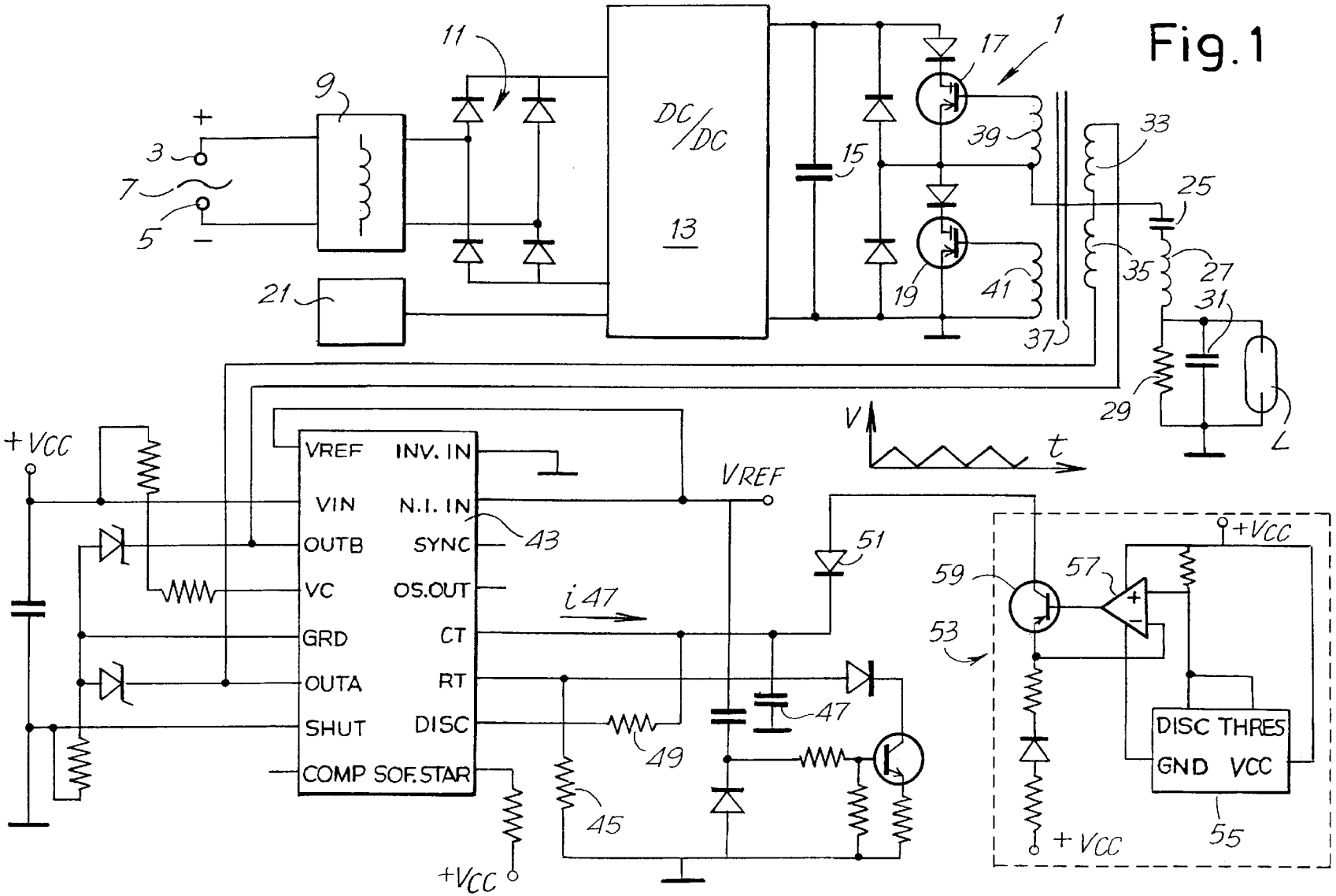
FIG. 1 is a circuit diagram embodying the present invention.

The upper part of the circuit diagram in FIG. 1 is a simplified diagram of a ballast 1 for the supply of a lamp L of the HID type.

The ballast 1 has two connections 3 and 5 to an alternating voltage source 7, for example the electrical main. A filter 9 is interposed between the source 7 and the ballast. The main voltage is rectified by a bridge rectifier 11 followed by a DC/DC converter indicated as a whole by the number 13, a clamping capacitor 15 and two electronic switches 17 and 19 in a half-bridge configuration. The number 21 indicates as a whole a control circuit for the DC/DC converter 13. The inverter, formed by the two controlled switches 17 and 19, is connected to the lamp through an inductor 27 and a capacitor 25. The numbers 29 and 31 indicate an RC circuit in parallel with the lamp L.

The turning off and on of the switches 17 and 19 is controlled by inductors 33, 35 wound on a common core 37, on which are wound the inductors 39, 41 connected to the bases of the transistors 17 and 19 which form the controlled switches of the inverter.

Figure 2:
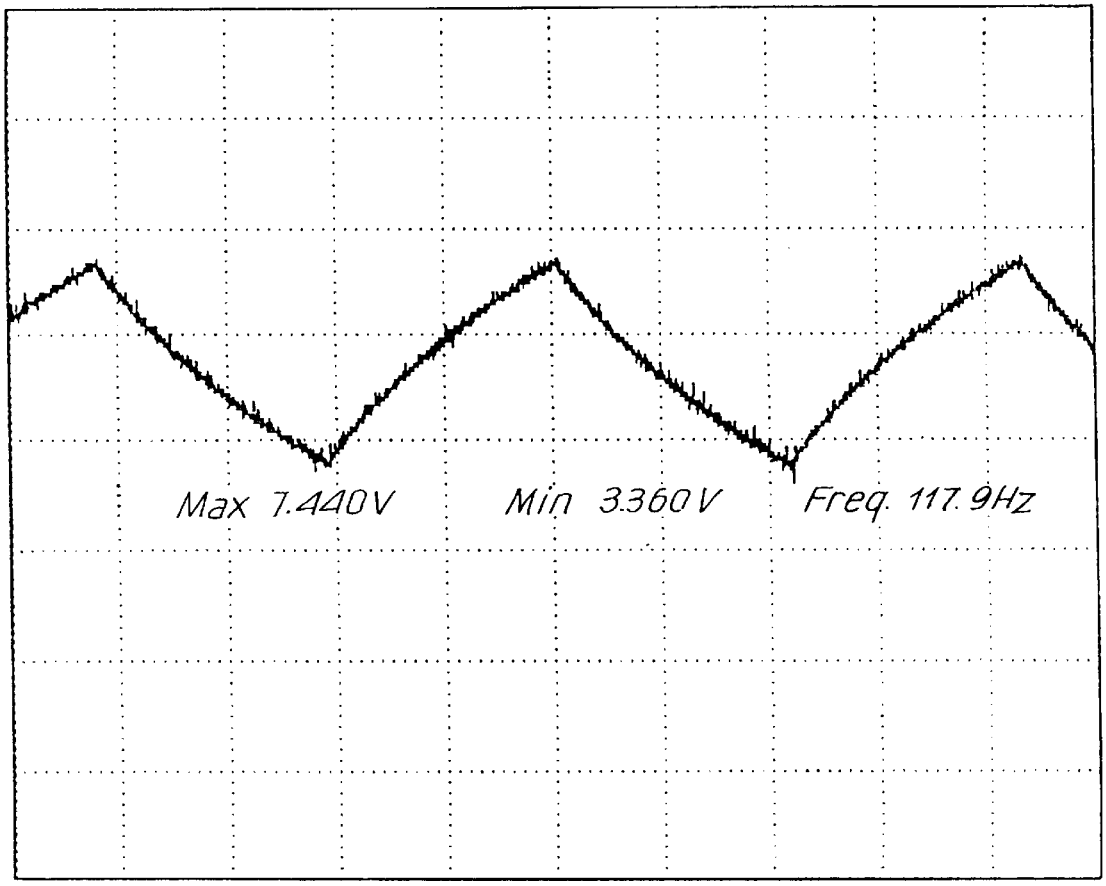
FIG. 2 is a graph showing the variation of the modulating signal with time.

The switches 17 and 19 are made conducting and non-conducting alternately to supply the lamp L with a voltage which varies according to the law:

$$v(t)=V_{sin}(w_0t+\theta(t)) \quad (1)$$

where t is the time, w is a fundamental frequency of the carrier signal and $\theta(t)$ is a modulating signal whose derivative in time has a triangular variation as shown in FIG. 2, with a frequency of the order of 80–150 Hz for example, and preferably of the order of 100–130 Hz, the optimal value being approximately 115–118 Hz. The lower part of the diagram in FIG. 1 shows a possible circuit solution to provide frequency modulation of the switching signal of the switches 17 and 19 with a modulating signal having a triangular waveform of the type shown in FIG. 2. The number 43 indicates a PWM circuit, for example a type UC2525A or equivalent integrated circuit, the sixteen pins of which are indicated with the corresponding standard nomenclature. The output pins OUTA and OUTB supply the signals, in opposite phases, to the switches 17 and 19 to control the inverter. The frequency of the signals on OUTA and OUTB (and therefore the switching frequency of the inverter) depends on the components connected to the RT and CT pins. The RT pin is connected to earth through a resistor 45, while the CT pin is connected to a capacitor 47 and, through a resistor 49, to the discharge pin DISC. Under normal operating conditions, the capacitor 47 is gradually charged by a current $i_{47}$, with a consequent increase in voltage on the CT terminal. The internal configuration of the circuit 43 is such that, when the voltage on the CT terminal reaches a predetermined value, the capacitor 47 is rapidly discharged through the resistor 49 to the DISC terminal.

Figure 3:
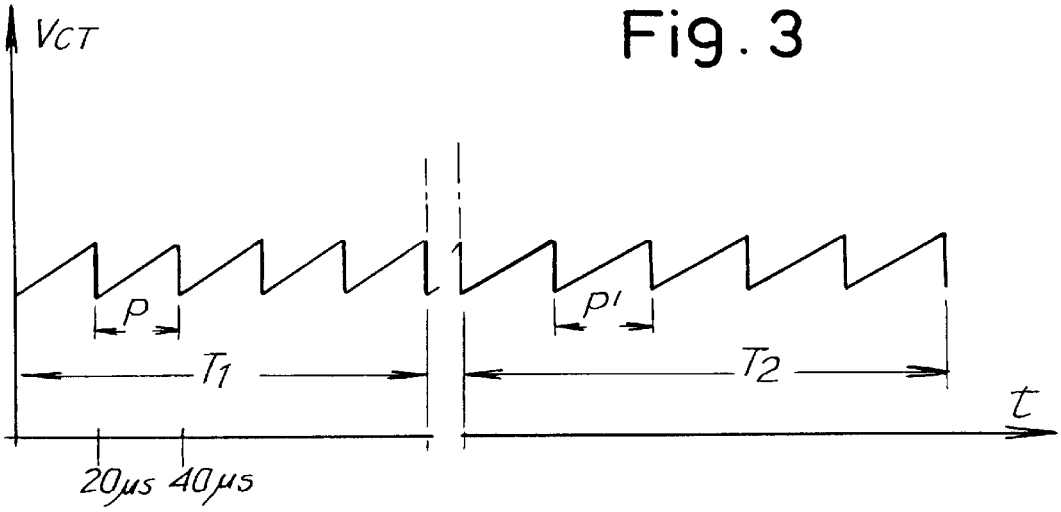
FIG. 3 is a graph showing the voltage on the CT pin of the PWM circuit as a function of time.

In the absence of further circuit components connected to the CT and RT terminals, the voltage on CT would have a saw-tooth variation of the type shown in FIG. 3, but with a constant frequency of the carrier signal on the OUTA and OUTB terminals.

To obtain frequency modulation, the positive plate of the capacitor 47 is connected, through a diode 51, to a triangular-wave current generator indicated as a whole by the number 53. The configuration of the generator 53 is not described in detail, since it can be made in a way known to those skilled in the art. In general, it may comprise a timer 55, for example an integrated circuit of the IC555 type, an operational amplifier 57 connected to the timer 55, and a transistor 59 which has its base connected to the output of the operational amplifier 57, its emitter connected to the inverting terminal of the amplifier 57 and its collector to the diode 51.

The generator 53 generates a current having a triangular waveform qualitatively matching the variation of the modulating signal shown in FIG. 2, with a frequency, as specified above, of the order of 110–130 Hz. In the example illustrated, the pre-set frequency is 116 Hz. With this configuration, the capacitor 47 is charged with a current which is the sum of the current $i_{47}$ from the CT terminal and the current from the generator 53. The latter current varies in time with a variation much slower than that of the nominal switching frequency.

In this way, the charging period of the capacitor 47, up to the voltage which causes the discharge through the DISC terminal, varies in time with a variation corresponding to that of the output current from the generator 53. Consequently, the voltage across the capacitor 47 has a saw-tooth variation with a non-constant frequency, corresponding to a non-constant frequency of the switching signal on the OUTA and OUTB terminals.

FIG. 3 shows the qualitative variation with time of the voltage $V_{CT}$ on the CT terminal. In order to show the effect of the frequency modulation obtained with the current from the generator 53, two portions of the voltage signal in time intervals $T_1$ and $T_2$, separated from each other by an interval approximately equal to the half-period of the triangular wave generated by the generator 53, are shown in FIG. 3 on the same time diagram. The frequency of the voltage signal on the CT terminal is higher than the interval $T_1$ in which there is a higher value of the current from the generator 53. Conversely, the frequency of $V_{CT}$ is lower in the period $T_2$, in which the charging of the capacitor 47 is slower, since the current from the generator 53 is lower. Each period P, P' of the voltage signal $V_{CT}$ corresponds to one cycle of the PWM generator 43, whose output on OUTA and OUTB will thus contain a modulating signal having the variation shown in FIG. 2.

Figure 4:
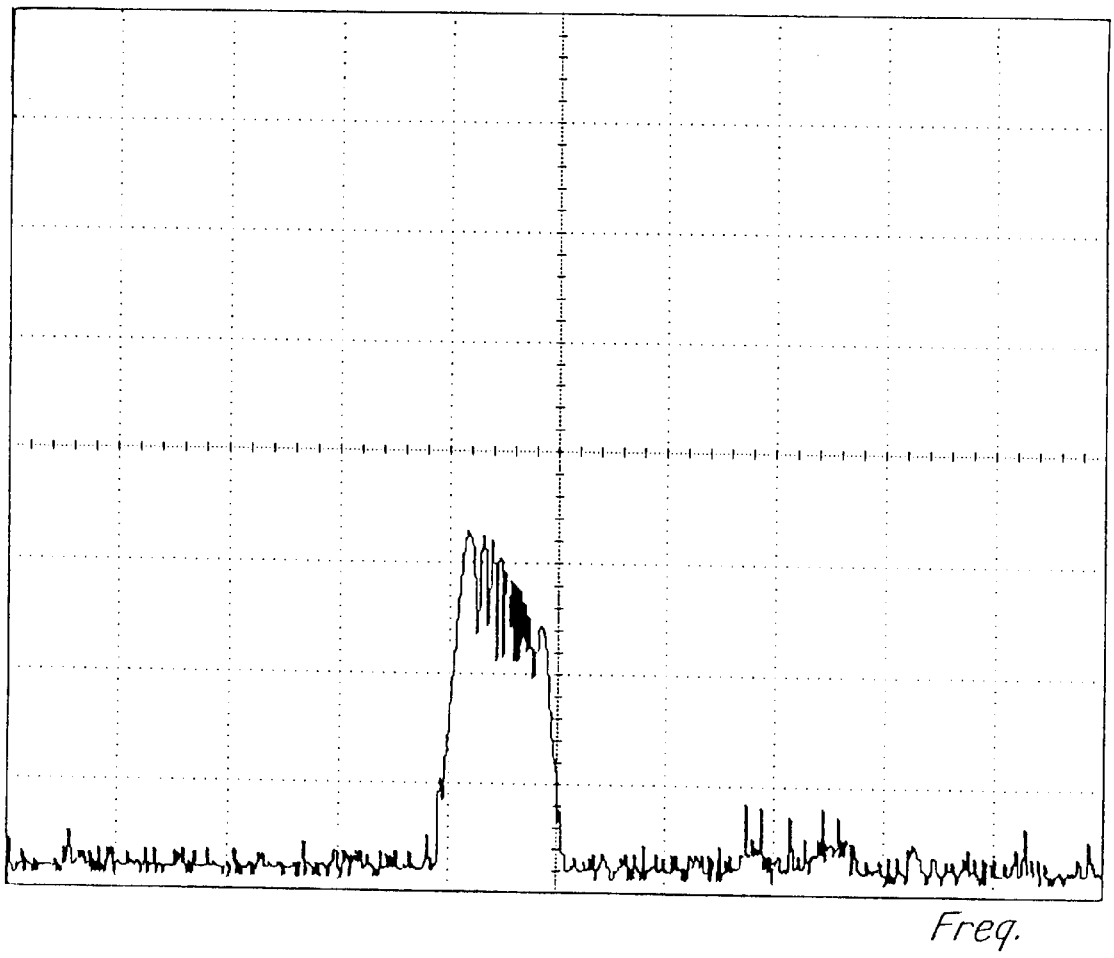
FIG. 4 is a graph showing the variation of the current to the lamp in the frequency domain.

As a result of the switching of the switches 17 and 19 by means of the signals on OUTA and OUTB, a current $I_L$, whose variation in the frequency domain is shown in FIG. 4, will flow to the lamp L. The diagram in FIG. 4 was obtained for a modulation band width of 5 kHz, at a modulation frequency of 116 Hz. As seen in FIG. 4, the spectrum shows a virtually uniform spectral energy density in the window between 20 and 25 kHz, when $w_0$ (see Equation (1)) is assumed to have a value of 22.5 kHz.

Figure 5:
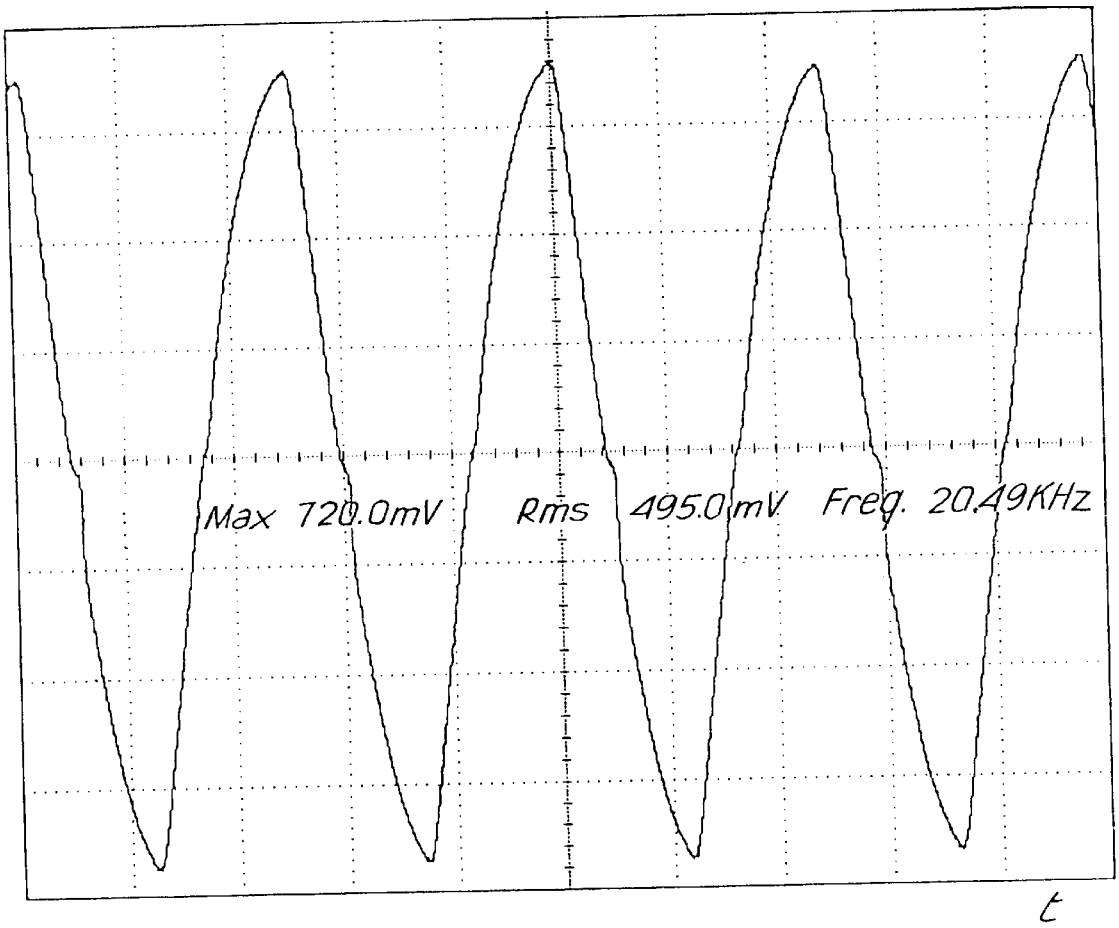
FIG. 5 is a graph showing the variation of the current in the lamp as a function of time.

FIG. 5 shows the variation of the current to the lamp as a function of time, for an apparent instantaneous frequency of 20.49 kHz.

It is to be understood that the drawing shows only one example provided solely as a practical demonstration of the invention, and that this invention may vary in its forms and dispositions without thereby departing from the scope of the guiding concept of the invention. Any reference numbers in the attached claims have the purpose of facilitating the reading of the claims with reference to the description and to the drawing, and do not limit the scope of protection represented by the claims.

I claim:

1. An electronic ballast comprising:

an inverter section to supply a load at a variable frequency;

control means for generating a switching signal of a variable frequency for the inverter section; and means for modulating the frequency of the switching signal with a modulating signal, the modulating signal having a triangular waveform such that the frequency of the signal provided to the load is continuously variable.

2. The electronic ballast according to claim 1, wherein the modulating means comprises a capacitor and a triangular-wave current generator, the output of the triangular-wave current generator being connected to the capacitor, the rate of charging of the capacitor determining the frequency of the switching signal.

3. The electronic ballast according to claim 2, wherein the modulating means and an operational amplifier, the timer being connected to the operational amplifier to control the turning off and on of a transistor.

4. A method of varying the operating frequency of an electronic ballast driving a discharge lamp, the discharge lamp having a resonant operating frequency, comprising the steps of:

a. generating a modulation control signal having a triangular waveform;

b. generating a pulse width modulated switching signal at a switching frequency that varies in response to the modulation control signal; and c. varying the operating frequency of the ballast in response to the switching signal whereby the ballast operating frequency varies from the resonant operating frequency.

5. The method of claim 4 further comprising varying the switching frequency in response to the modulation control signal through the charging and discharging of a capacitor.

* * * * *